US007350376B2

(12) United States Patent
Couling

(10) Patent No.: US 7,350,376 B2
(45) Date of Patent: Apr. 1, 2008

(54) JEWELRY CLASP

(76) Inventor: Denise Couling, 11258 Sandy Creek Ct., South Lyon, MI (US) 48178

( * ) Notice: Subject to any disclaimer, the term of this patent is extended or adjusted under 35 U.S.C. 154(b) by 0 days.

(21) Appl. No.: 10/924,125

(22) Filed: Aug. 23, 2004

(65) Prior Publication Data

US 2005/0039487 A1 Feb. 24, 2005

Related U.S. Application Data

(60) Provisional application No. 60/497,278, filed on Aug. 22, 2003.

(51) Int. Cl.
*A44C 5/00* (2006.01)

(52) U.S. Cl. ..... 63/3.1; 63/3

(58) Field of Classification Search ..... 63/3.1, 63/3, 4, 15.2, 6, 22, 33, 38, 40, 3.2, 10, 9, 63/8

See application file for complete search history.

(56) References Cited

U.S. PATENT DOCUMENTS

| | | | | | |
|---|---|---|---|---|---|
| 1,380,827 | A | * | 6/1921 | Mullins | 63/3.1 |
| 1,813,963 | A | | 7/1931 | Schick | |
| 2,586,758 | A | | 2/1952 | Zerr | 24/73 |
| 2,598,597 | A | * | 5/1952 | Philippe | 267/71 |
| 2,615,227 | A | * | 10/1952 | Hornik | 24/303 |
| 2,644,992 | A | * | 7/1953 | McFarland | 24/116 A |
| 3,098,364 | A | * | 7/1963 | Verri | 63/1.16 |
| 3,135,031 | A | | 6/1964 | Brosse | 24/73 |
| 3,621,651 | A | | 11/1971 | Gillespie | 59/85 |
| 4,000,627 | A | * | 1/1977 | Wahlbeck | 63/3.1 |
| 4,382,319 | A | | 5/1983 | Mones Mendoza | 24/376 |
| 4,527,316 | A | | 7/1985 | Murphy | 24/616 |
| 4,549,411 | A | * | 10/1985 | Ivey | 63/1.16 |
| 5,341,659 | A | | 8/1994 | Wright | 63/2 |
| 5,687,585 | A | | 11/1997 | Ferrell | 63/21 |
| 5,689,867 | A | * | 11/1997 | Katz | 24/587.1 |
| 5,794,459 | A | | 8/1998 | Ignatowski | 63/38 |
| 5,893,198 | A | | 4/1999 | DeCotis | 24/3.3 |
| 6,138,356 | A | * | 10/2000 | Hertelendy | 29/896.41 |
| 6,308,385 | B1 | | 10/2001 | Ball | 24/574.1 |
| 6,422,036 | B1 | | 7/2002 | Giannis et al. | 63/3.1 |
| 2002/0148251 | A1 | | 10/2002 | Plumly | 63/3 |
| 2003/0010057 | A1 | | 1/2003 | Hunter | 63/3.1 |
| 2003/0110798 | A1 | | 6/2003 | Ignatowski | 63/38 |
| 2004/0007017 | A1 | * | 1/2004 | Flaherty | 63/3.1 |
| 2004/0194502 | A1 | * | 10/2004 | Ma | 63/3.1 |

* cited by examiner

*Primary Examiner*—Katherine Mitchell
*Assistant Examiner*—David C Reese
(74) *Attorney, Agent, or Firm*—Gifford, Krass, Sprinkle, et al.

(57) ABSTRACT

A jewelry clasp supports a plurality of strands of jewelry each with opposite ends having terminal fasteners. The jewelry clasp includes selectively connectable first and second segments. Each of the segments includes a spanner portion having opposite ends and a strand retainer bar extending from at least one of the ends. The strand retainer bars are adapted to selectively couple with the opposite ends of each strand of jewelry for maintaining a desired positional relationship between the plurality of strands of jewelry.

9 Claims, 1 Drawing Sheet

JEWELRY CLASP

RELATED APPLICATIONS

This application is a non-provisional application claiming priority of U.S. Provisional Application Ser. No. 60/497,278, filed Aug. 22, 2003; the contents of which are incorporated herein by reference.

FIELD OF THE INVENTION

The present invention generally relates to jewelry clasps, and in particular, to a clasp having complementary closed portions adapted to selectively engage at least one chain or bead strand.

BACKGROUND OF THE INVENTION

Traditionally, a jewelry chest has had to contain a variety of necklaces, bracelets, anklets, and the like, in order to provide jewelry complementary to apparel and suitable for various social functions. As a result, there is a considerable expense associated with buying specialized jewelry articles and, further, the transfer of pendants or beaded sections between articles.

While one can wear multiple strands simultaneously, often a desired appearance with multiple strand wear requires a relative positional relationship therebetween. While a relationship between multiple strands is readily provided at the beginning of the day, it is often the case that a longer strand in a graded strand positional relationship can work around a wearer's neck on top of the other strands and thereby destroy the evenly graduated appearance of the strands. Alternatively, if a pendent or central element of a strand shifts from its initial position, the desired appearance is impaired. Additionally, securing a strand with a conventional clasp is a delicate and time-consuming process that predisposes a wearer to avoid multiple strand jewelry even though the wearer is desirous of the appearance. Thus, there exists a need for a reliable clasp suitable for engaging a variety of beaded strands or chains.

SUMMARY OF THE INVENTION

According to one aspect of the invention, a jewelry clasp is provided for supporting a plurality of strands of jewelry each with opposite ends having terminal fasteners. The jewelry clasp includes a first segment and a second segment. The first segment and second segment are selectively connectable to each other, each having a spanner portion with opposite ends and a strand retainer bar extending from at least one of the ends. The strand retainer bars are adapted to selectively couple with the opposite ends of each strand of jewelry for maintaining a desired positional relationship between the plurality of strands of jewelry.

According to another aspect of the invention, the strand retaining bar is subdivided to define a plurality of apertures. Each of the apertures is adapted to allow attachment of at least one terminal fastener therethrough.

According to another aspect of the invention, the apertures have a spaced orientation along the strand retainer bar for maintaining the desired positional relationship between the plurality of strands of jewelry.

DESCRIPTION OF THE DRAWINGS

The present invention is further illustrated with reference to the accompanying drawings of preferred embodiments. These drawings are not intended to limit the scope of the invention as claimed.

DESCRIPTION OF THE INVENTION

The present invention has utility as a securement for a stranded or chained body ornamentation. While the present invention is described herein with respect to a necklace, it should be appreciated that the present invention is equally well suited for use as a bracelet, belt, anklet or beaded headwear.

The present invention allows one to wear multiple strands simultaneously and retain the positional relationship therebetween. Additionally, the present invention promotes ease of strand securement and further prevents clasp travel during the course of wear to a position where the clasp becomes prominently displayed.

Figure 1:
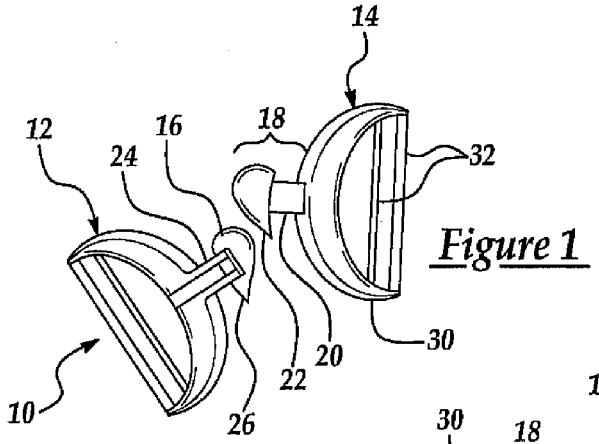
FIG. 1 is a perspective rear view of a segment of an inventive embodiment in an unclasped configuration and the complementary segment in planar view.
Figure 2:
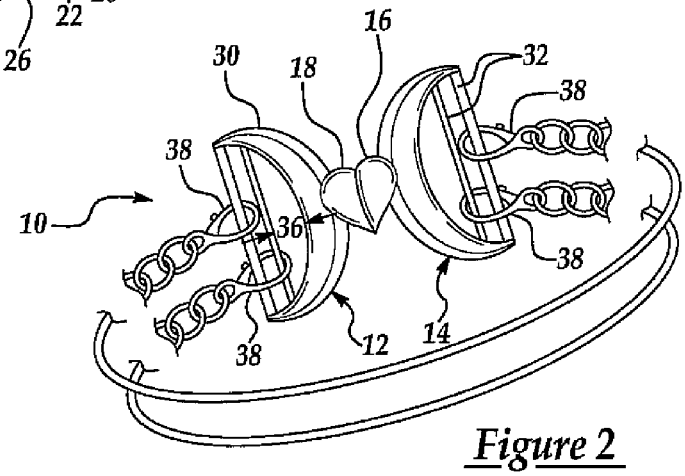
FIG. 2 is a perspective planar view of the inventive embodiment of FIG. 1 depicted in a clasped configuration.

Referring to FIGS. 1 and 2, the inventive clasp is shown generally at 10. The clasp 10 includes at least two closed-loop segments 12 and 14. The first 12 and second 14 segments are selectively connectable through interlockable first fastener portion 16 and second fastener portion 18. Preferably, the first 16 and second 18 fastener portions have a conventional slotted tension configuration, as known by those having ordinary skill in the art. More specifically, the second fastener portion 18 includes a projecting shaft 20 terminating at a widened head 22. The first fastener portion 16 includes a pair of parallel extenders 24. The extenders 24 are spaced apart to allow the head 22, after a rotation, to pass therebetween. After passage of the head 22 between the extenders 24, an additional rotation allows the shaft 20 to be slidably supported therebetween. Contact between the head 22 and the extenders 24 prevents removal of the shaft 20 therefrom. It should be appreciated that other conventional fastener systems can be used to selectively secure the clasp segments 12 and 14.

Each of the first 12 and second 14 clasp segments has a spanner portion 30 having opposite ends. Strand dual retainer bars 32 extend from at least one of the opposite ends of the spanner portion 30. Preferably, the strand dual retainer bars 32 extend between the opposite ends of the spanner portion 30. Most preferably, the dual strand retaining bars 32 are brazed or otherwise secured to the ends of the spanner portion 30 to form a closed-loop segment. It should be appreciated that a complete segment 12 or 14 is optionally molded from metal or plastic as a unitary piece.

Preferably, the spanner portion 30 extends arcuately between the opposite ends. It should, however, be appreciated that the spanner portion 30 can be formed in a variety of shapes, such as the shape of a "C", "D", "U", a disc, a discoid, a continuous or perforated sheet, and more complex shapes. Additionally, it should be appreciated that the spanner portion can include embossments, inlays and ornamental colorations.

A gap 36 is defined between the spanner portion 30 and the retainer bars 32. The gap 36 is adapted to receive a conventional lobster claw type strand securement 38. The gap 36 separates the retainer bars 32 from the spanner portion 30 at least one point along the length of the retainer bars 32. The closed loop nature of the inventive clasp segment 12, 14 affords greater durability over conventional clasps having selectively openable segments. The strand retaining bars 32, like the spanner portion 30, are readily formed from a variety of materials conventional to the art. These materials illustratively include gold alloys, silver, pewter, brass, platinum, plastic and combinations thereof.

In operation, the inventive clasp is separated into the at least two segments 12, 14 through disengagement of the fastener portions 16, 18. As best shown in FIG. 2, one end of a strand is secured to the strand retainer bars 32 of one of the segments 12 using a terminal fastener such as a lobster claw fastener 38. In the same manner, the remaining free end of the strand is then secured to the strand retainer bar 32 of the other of the segments 14. A user then drapes the strand about a body appendage such as a wrist, neck or ankle and secures the central segment fastener. Preferably, multiple strands are linked between the segments 12, 14 of the inventive clasp. The positional relationship the multiple strands is maintained by the inventive clasp.

Figure 3:
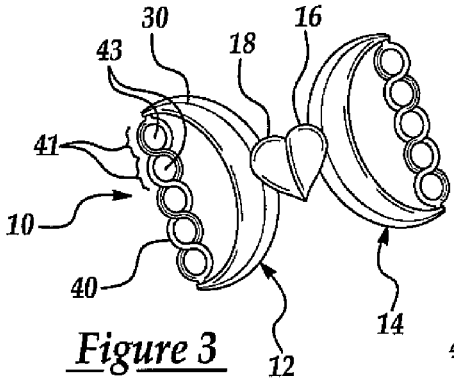
FIG. 3 is a perspective planar view of an alternative embodiment of the present invention.
Figure 4:
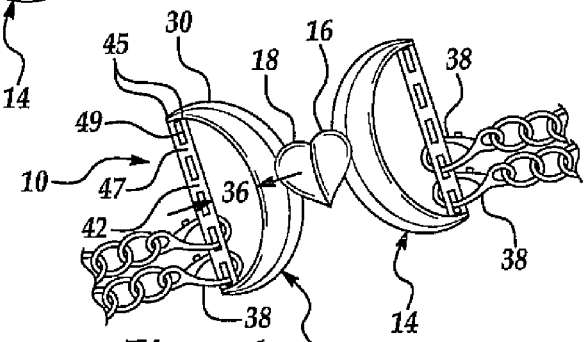
FIG. 4 is a perspective planar view of still another alternative embodiment of the present invention.

Alternative embodiments of the inventive clasp are shown in FIGS. 3 and 4, wherein like numerals correspond to those described in relation to FIGS. 1 and 2. In FIG. 3, a subdivided strand retainer bar 40 is formed by twisting a pair of wire segments to define a plurality of ring sections 41. The plurality of ring sections 41 are positioned end to end and define a plurality of apertures 43 having a preselected spaced orientation along the strand retainer bar 40. Preferably, the ring sections 41 and corresponding apertures 43 have a generally circular shape, but each can have any desired shape that is the same or different from that of the other ring sections and apertures.

In FIG. 4, the subdivided strand retainer bar 42 is generally ladder shaped. More specifically, the retainer bar 42 includes spaced apart longitudinal members 45 extending between the ends of the spanner portion 30. The retainer bar 42 has a plurality of rungs 47 extends transversely between the longitudinal members 45. The rungs 47 are spaced apart to define a plurality of apertures 49 therebetween. Preferably, each apertures 49 is generally rectangular, but can have any desired shape that is the same or different from that of the other apertures.

In both embodiments of FIGS. 3 and 4, the apertures 43, 49, respectively, are adapted to allow attachment of at least one terminal fastener, such as a lobster claw fastener, therethrough. The apertures 43, 49 have a preselected spaced orientation along the subdivided strand retainer bar 40, 42, respectively, for maintaining a desired positional relationship between a plurality of strands of jewelry connected thereto.

The invention has been described in an illustrative manner. It is, therefore, to be understood that the terminology used is intended to be in the nature of words of description rather than of limitation. Many modifications and variations of the invention are possible in light of the above teachings. Thus, within the scope of the appended claims, the invention may be practiced other than as specifically described.

The invention claimed is:

1. A jewelry clasp for supporting a plurality of strands of jewelry each having opposite ends with terminal fasteners, the jewelry clasp comprising:

a first segment and a second segment, the first segment and second segment being selectively connectable to each other, each having a spanner portion with opposite ends and a strand retainer bar extending from at least one of the ends, the strand retainer bars being adapted to selectively couple with the opposite ends of each strand of jewelry for maintaining a desired positional relationship between the plurality of strands of jewelry, wherein the strand retainer bar comprises at least two wire segments twisted about each other to define a plurality of ring sections, each ring section being adapted to allow attachment of at least one terminal fastener thereto.

2. A jewelry clasp as set forth in claim 1, wherein the plurality of ring sections defines a plurality of apertures, one of the plurality of apertures being adapted to allow attachment of at least one terminal fastener therethrough.

3. A jewelry clasp as set forth in claim 2, wherein the apertures have a spaced orientation along the strand retainer bar maintaining the desired positional relationship between the plurality of strands of jewelry.

4. A jewelry clasp as set forth in claim 1 wherein each spanner portion extends arcuately between their respective opposite ends.

5. A jewelry clasp as set forth in claim 1, wherein the spanner portions are generally opposed upon connection of the first and second segments.

6. A jewelry system comprising:

a plurality of strands, each of said plurality of strands with a first end terminating in a first terminal lobster claw fastener and a second end terminating in a second terminal lobster claw fastener;

the clasp according to claim 1 being adapted to selectively couple the two opposite terminal fasteners of each strand of jewelry for maintaining a desired positional relationship between the plurality of strands of jewelry.

7. A jewelry system as set forth in claim 6, wherein the plurality of ring sections of the clasp have a spaced orientation along the first strand retainer bar and ring sections in the second strand retainer bar for maintaining the desired positional relationship between the plurality of strands of jewelry.

8. A jewelry system as set forth in claim 6 wherein each of the first and second spanner portions extend arcuately between their respective opposite ends, the first and second spanner portions are generally opposed upon connection of the first and second segments.

9. A jewelry system as set forth in claim 6, wherein each of the first and second strand retainer bars comprise a plurality of apertures, one of the apertures being adapted to allow attachment of at least one terminal fastener therethrough.

* * * * *